US011587504B2

(12) United States Patent
Li et al.

(10) Patent No.: US 11,587,504 B2
(45) Date of Patent: Feb. 21, 2023

(54) DRIVING METHOD OF DISPLAY DEVICE AND DISPLAY DEVICE

(71) Applicant: Everdisplay Optronics (Shanghai) Co., Ltd., Shanghai (CN)

(72) Inventors: Xiangshu Li, Shanghai (CN); JehYen Kang, Shanghai (CN); Fei Shen, Shanghai (CN); Keitaro Yamashita, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 17/381,235

(22) Filed: Jul. 21, 2021

(65) Prior Publication Data

US 2022/0044628 A1 Feb. 10, 2022

(30) Foreign Application Priority Data

Aug. 6, 2020 (CN) ..... 202010784487.2

(51) Int. Cl.
*G09G 3/3208* (2016.01)

(52) U.S. Cl.
CPC ... *G09G 3/3208* (2013.01); *G09G 2300/0842* (2013.01); *G09G 2310/061* (2013.01); *G09G 2310/08* (2013.01); *G09G 2320/0233* (2013.01)

(58) Field of Classification Search
CPC ..... G09G 3/3208; G09G 2310/061; G09G 2310/08; G09G 2320/064; G09G 2300/0842
USPC ..... 345/504
See application file for complete search history.

(56) References Cited

U.S. PATENT DOCUMENTS

| | | | | |
|---|---|---|---|---|
| 2014/0361960 | A1 | 12/2014 | Yamauchi | |
| 2018/0122327 | A1 | 5/2018 | Kim et al. | |
| 2020/0074932 | A1* | 3/2020 | Park | G09G 3/3233 |
| 2020/0211475 | A1* | 7/2020 | Park | G09G 3/3275 |
| 2020/0265786 | A1* | 8/2020 | Li | G09G 3/3266 |
| 2021/0201783 | A1* | 7/2021 | Oh | G09G 3/3266 |

(Continued)

FOREIGN PATENT DOCUMENTS

| | | | |
|---|---|---|---|
| CN | 102129829 | A | 7/2011 |
| CN | 108877660 | A | 11/2018 |
| CN | 110599958 | A | 12/2019 |

(Continued)

OTHER PUBLICATIONS

1st Office Action dated Jul. 14, 2022 of Chinese Application No. 202010784487.2.

*Primary Examiner* — Prabodh M Dharia
(74) *Attorney, Agent, or Firm* — Qinghong Xu

(57) ABSTRACT

A driving method includes: generating and outputting a frame image signal to an organic light emitting device, wherein the frame image signal includes an active data region and a blank region based on a time sequence; in the active data region of the frame image signal, using a timing controller to write a data voltage into the gate of the thin film transistor, store it in a storage capacitor, and apply it to the organic light emitting device through the thin film transistor; and in response to reaching the blank region of the frame image signal as determined by the timing controller, changing the first voltage at the cathode of the organic light emitting device to compensate the operating current of the organic light emitting device.

8 Claims, 8 Drawing Sheets

(56) References Cited

U.S. PATENT DOCUMENTS

| | | | | |
|---|---|---|---|---|
| 2021/0358400 | A1* | 11/2021 | Wang | G09G 3/3208 |
| 2022/0036812 | A1* | 2/2022 | Noh | G09G 3/3233 |

FOREIGN PATENT DOCUMENTS

| | | | |
|---|---|---|---|
| CN | 110875011 | A | 3/2020 |
| CN | 110890073 | A | 3/2020 |
| CN | 11341266 | A | 6/2020 |
| CN | 111383594 | A | 7/2020 |
| WO | 2019187062 | A1 | 10/2019 |

* cited by examiner

DRIVING METHOD OF DISPLAY DEVICE AND DISPLAY DEVICE

CROSS-REFERENCE TO RELEVANT APPLICATION

The present application claims the priority of the Chinese patent application No. 202010784487.2, filed on Aug. 6, 2020, the entire disclosure of which is incorporated herein by reference for all purposes.

TECHNICAL FIELD

The present disclosure relates to the field of display technology, and in particular, to a driving method of a display device and a display device.

BACKGROUND

FIG. 1 is a schematic diagram for the brightness change when display at 30 Hz under low gray scale according to the prior art. FIG. 2 is a schematic diagram for the brightness change when display at 60 Hz under low gray scale according to the prior art. FIG. 3 is a schematic diagram for the brightness change when display at 30 Hz under high gray scale according to the prior art. FIG. 4 is a schematic diagram for the brightness change when display at 60 Hz under high gray scale according to the prior art. Referring to FIGS. 1 to 4, results measured by an optical measurement tool under the low gray level (Grey32) and the high gray level (Grey255) are shown, wherein the horizontal axis is the time sequence, and the vertical axis is the brightness change. FIG. 5 is a brightness change curve under 64 gray scales switched from 30 Hz to 60 Hz according to the prior art. Referring to FIG. 5, where the unit of the horizontal axis is per second (time) and the unit of the vertical axis is nits (brightness), it can be seen that due to the existence of TFT leakage and hysteresis effects, the gray scale at the beginning of each frame is low, especially at low gray scales. This leads to higher brightness at low frequencies than high frequencies. Because the human eye is very sensitive to brightness changes under low gray scales, there will be obvious brightness changes in the frequency changes (see FIGS. 1 and 2). Obvious brightness changes have always been a key issue in G-SYNC (VRR) driving.

However, under high gray levels, the TFT leakage and hysteresis effects are less affected, which is different from the effects presented under low gray levels. High frequencies will be brighter, and low frequencies will be darker (see FIGS. 3 and 4).

For human eyes, the brightness change under low gray scale is more likely to cause visual disgust, and there is a need required to improve the brightness change under low gray scale.

It should be noted that the information disclosed in the above background section is only used to enhance the understanding of the background of the present disclosure, and therefore may include information that does not constitute the prior art known to those of ordinary skill in the art.

SUMMARY

One aspect of the present disclosure provides a driving method of a display device, including the following steps:

generating and outputting a frame of image signal to the organic light emitting device, the frame image signal including an active data region and a blank region based on a time sequence;

in the active data region of the frame image signal, using a timing controller to write the data voltage into the gate of the thin film transistor, store it in the storage capacitor, and apply it to the organic light emitting device through the thin film transistor; and in response to reaching the blank region of the frame image signal as determined by the timing controller, changing the first voltage at the cathode of the organic light emitting device to compensate the operating current of the organic light emitting device, thereby maintaining the brightness of the current frame image signal of the organic light emitting device to be the same as the brightness of the previous frame image signal.

According to an embodiment, the time duration for changing the first voltage of the organic light emitting device decreases as the frequency of the frame image signal increases.

According to an embodiment, as the first voltage of the organic light emitting device increases, the operating current of the organic light emitting device decreases.

According to an embodiment, after leaving the blank region of the frame image signal as determined by the timing controller, the first voltage at the cathode of the organic light emitting device is restored.

According to an embodiment, the first voltage is a cathode driving voltage.

Another aspect of the present disclosure provides a display device, including:

an organic light emitting device, wherein the cathode of the organic light emitting device is connected to a first voltage;

a first transistor, wherein the drain of the first transistor is connected to the anode of an organic light emitting device; and a second transistor, wherein the source of the second transistor is connected to a second voltage, the drain of the second transistor is connected to the source of the first transistor, and a capacitor is connected between the gate and the source of the second transistor, wherein a frame image signal is generated and outputted by a timing controller to the gate of the second transistor, the frame image signal is stored in the capacitor, the frame image signal includes an active data region and a blank region based on a time sequence, and after the first transistor is turned on, the frame image signal is input to the organic light emitting device; and in response to reaching the blank region of the frame image signal as determined by the timing controller, the first voltage at the cathode of the organic light emitting device is changed to compensate the operating current of the display device, thereby maintaining the brightness of the current frame image signal of the display device to be the same as the brightness of the previous frame image signal.

According to an embodiment, the time duration for changing the first voltage of the organic light emitting device decreases as the frequency of the frame image signal increases.

According to an embodiment, as the first voltage of the organic light emitting device increases, the operating current of the organic light emitting device decreases.

According to an embodiment, after leaving the blank region of the frame image signal as determined by the timing controller, the first voltage at the cathode of the organic light emitting device is restored.

According to an embodiment, the first voltage is a cathode driving voltage, and the second voltage is an anode driving voltage.

BRIEF DESCRIPTION OF THE DRAWINGS

The drawings here are incorporated into the specification and constitute a part of the specification, show embodiments in accordance with the present disclosure, and are used together with the specification to explain the principle of the present disclosure. Obviously, the drawings in the following description are only some embodiments of the present disclosure. For those of ordinary skill in the art, other drawings can be obtained based on these drawings without creative work.

DETAILED DESCRIPTION OF THE EMBODIMENTS

Figure 1:
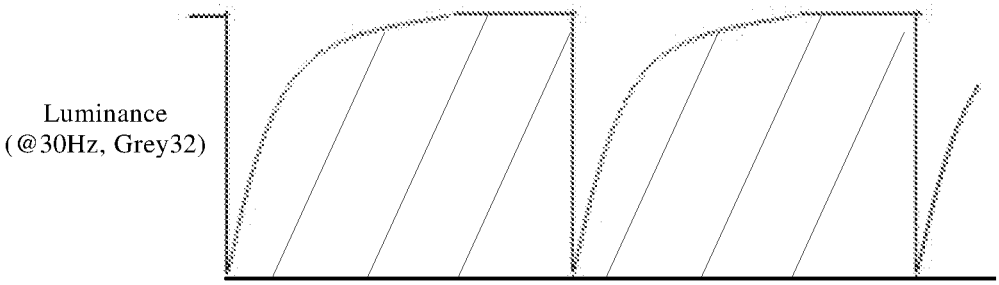
FIG. 1 is a schematic diagram for the brightness change when display at 30 Hz under low gray scale according to the prior art.
Figure 2:
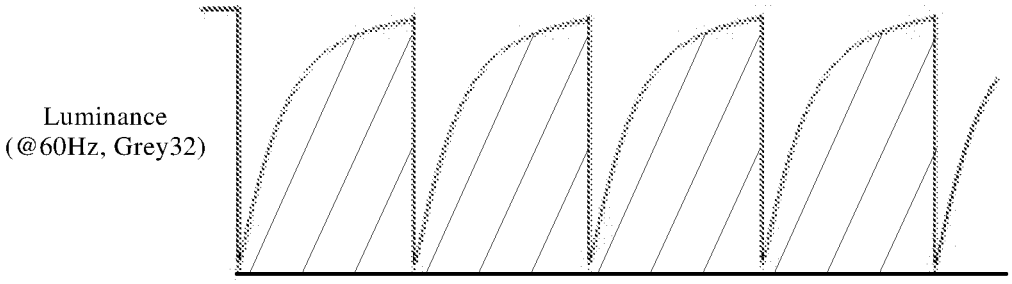
FIG. 2 is a schematic diagram for the brightness change when display at 60 Hz under low gray scale according to the prior art.
Figure 3:
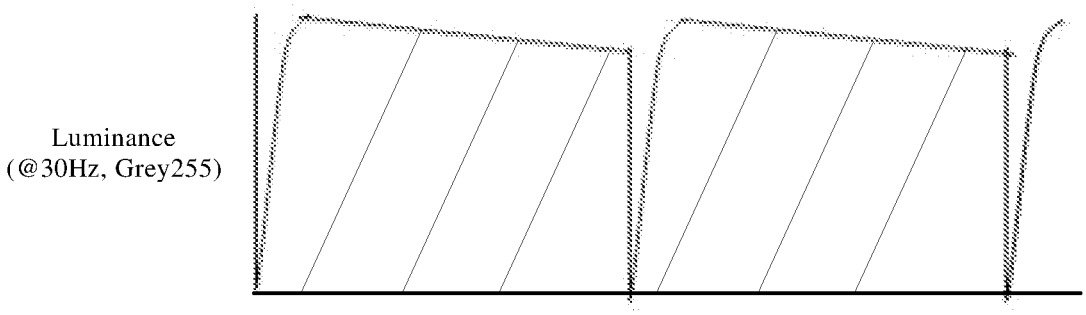
FIG. 3 is a schematic diagram for the brightness change when display at 30 Hz under high gray scale according to the prior art.
Figure 4:
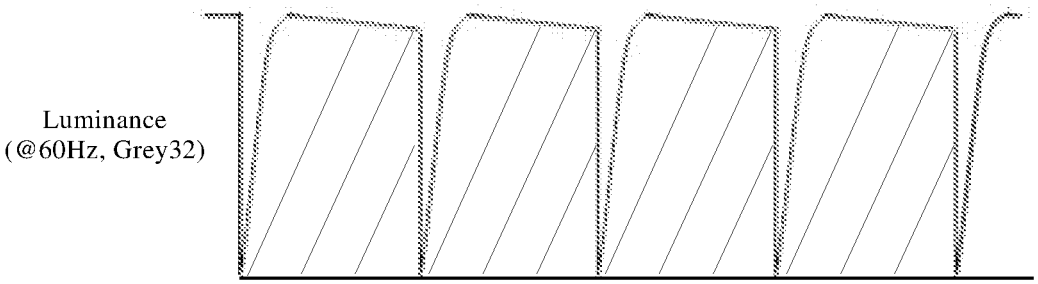
FIG. 4 is a schematic diagram for the brightness change when display at 60 Hz under high gray scale according to the prior art.
Figure 5:
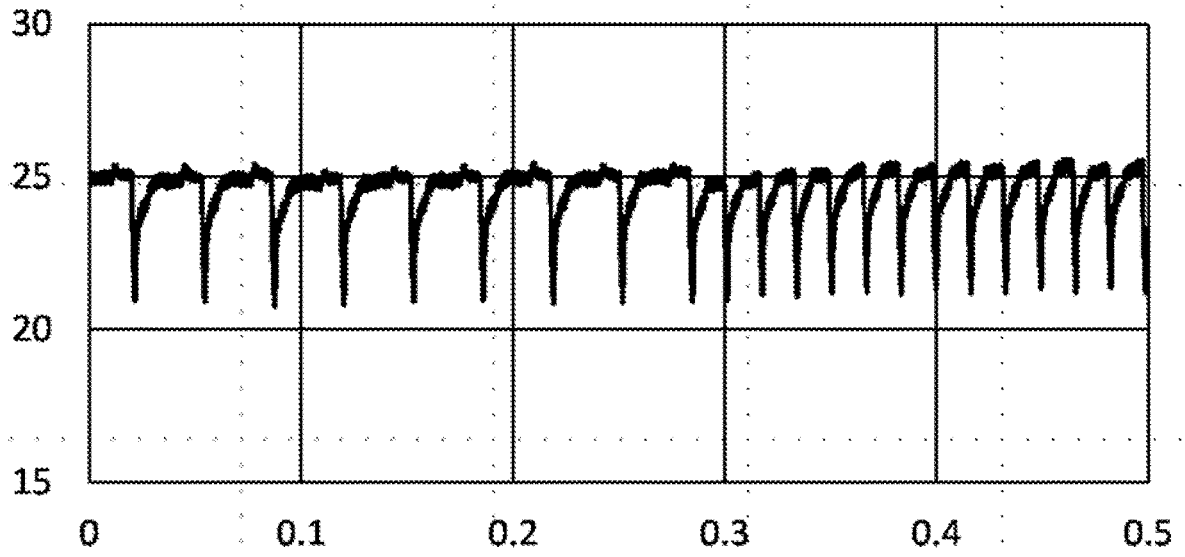
FIG. 5 is a brightness change curve under 64 gray scales switched from 30 Hz to 60 Hz according to the prior art.

Example embodiments will now be described more fully with reference to the accompanying drawings. However, the example embodiments can be implemented in various forms, and should not be construed as being limited to the embodiments set forth herein. On the contrary, these embodiments are provided so that the present disclosure will be comprehensive and complete, and will fully convey the concept of example embodiments to those skilled in the art. The same reference numerals in the figures indicate the same or similar structures, and thus their repeated description will be omitted.

In addition, the drawings are only schematic illustrations of the present disclosure, and are not necessarily drawn to scale. The same reference numerals in the figures denote the same or similar parts, and thus their repeated description will be omitted. Some of the block diagrams shown in the drawings are functional entities and do not necessarily correspond to physically or logically independent entities. These functional entities may be implemented in the form of software, or implemented in one or more hardware modules or integrated circuits, or implemented in different networks and/or processor devices and/or microcontroller devices.

The sequence numbers for the steps in the following method embodiments are only used to indicate different execution contents, and do not limit the logical relationship and execution order between the steps.

Figure 6:
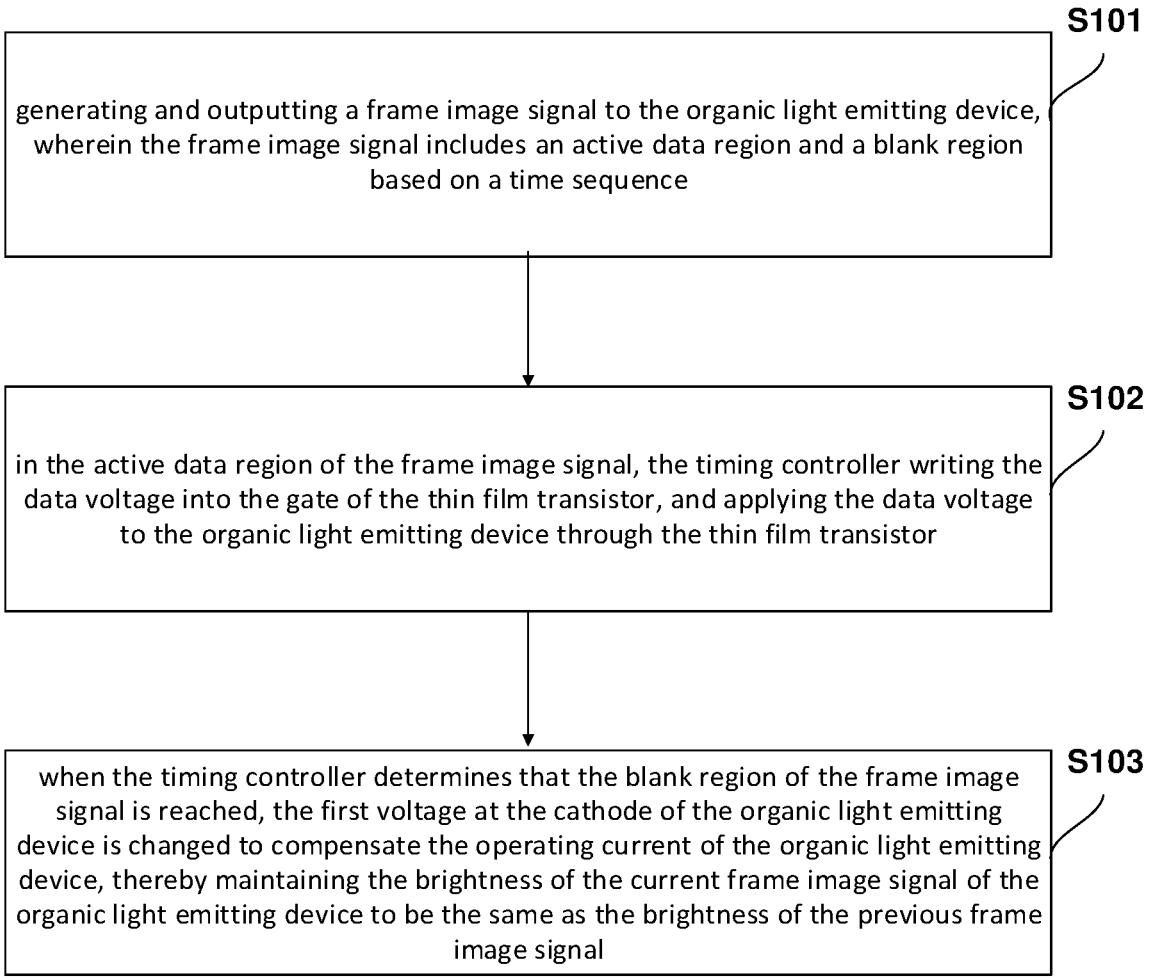
FIG. 6 is a schematic flowchart for the driving method of the display device according to the present disclosure.

FIG. 6 is a schematic flowchart for the driving method of the display device according to the present disclosure. As shown in FIG. 6, by taking the first voltage at the cathode of the OLED (i.e., the cathode driving voltage ELVSS) in a blank region as an example, the driving method of the display device according to the present disclosure includes the following steps.

In S101, a frame image signal is generated and outputted to the organic light emitting device. The frame image signal includes an active data region and a blank region based on a time sequence. The active data region in this embodiment has always a one-frame length of display frequency. In order to keep the display frequency synchronized with the GPU frequency in the VRR application, a blank region of variable length follows after the active data region is transmitted, and the total length of the two is used as the output of one frame.

In S102, in the active data region of the frame image signal, the timing controller writes the data voltage into the gate of the thin film transistor, stores it in the storage capacitor, and applies the data voltage to the organic light emitting device through the thin film transistor.

In S103, when the timing controller determines that the blank region of the frame image signal is reached, the cathode driving voltage ELVSS at the cathode of the organic light emitting device is changed to compensate the operating current of the organic light emitting device, thereby maintaining the brightness of the current frame image signal of the organic light emitting device to be the same as the brightness of the previous frame image signal. When the OLED emits light, the thin film transistors work in the saturation region regardless of being the active data region (active region) or the blank region. According to the present disclosure, by changing the ELVSS voltage, the characteristic of a non-ideal TFT changing Id slightly linearly in the saturation region is used to reduce the brightness change between adjacent frames when the frame rate changes.

According to the present disclosure, the brightness change under low gray scale can be improved through the above steps, and when the display frame rate changes, the brightness change between consecutive frames will be significantly improved.

In an embodiment, the time duration for changing the cathode driving voltage ELVSS of the organic light emitting device decreases as the frequency of the frame image signal increases.

In an embodiment, as the cathode driving voltage ELVSS of the organic light emitting device increases, the operating current of the organic light emitting device decreases.

In an embodiment, after leaving the blank region of the frame image signal as determined by the timing controller, the cathode driving voltage ELVSS at the cathode of the organic light emitting device is restored.

In Variable Refresh Rate Technology (VRR) applications, the frequency change is reflected in the length of Vtotal for each frame. By using the driving method of the display device according to the present disclosure, the time length for changing the ELVSS voltage is determined according to the time of Vtotal. That is, the time length for high-frequency change is short, and the time length for low-frequency change is long. The frequency in VRR changes in real time, and the brightness difference at each frequency needs to be kept as small as possible. The average brightness is kept constant by changing the ELVSS voltage. According to the measured brightness curves under 32 gray scales at different frequencies, it can be seen that by using the present disclosure, the brightness changes at different frequencies will be significantly improved.

According to the video signal mode in VRR applications, the frequency range of VRR is from display frequency/2.4 to display frequency. That is, if the display frequency is 60 Hz, the range will be from 25 Hz to 60 Hz, and if the display frequency is 144 Hz, the range will be from 60 Hz to 144 Hz. Besides, Vtotal=active+blank, meaning that the composition of the video signal is an active part and a blank part, wherein the active part has always a one-frame length of the display frequency. In order to keep the display frequency synchronized with the GPU frequency in the VRR application, a blank part of variable length follows after the active part is transmitted, and the total length of the two is used as the output of one frame. The length of the blank determines the frame rate of the frame. The low-frequency blank part is long, and the high-frequency blank part is short.

Figure 7:
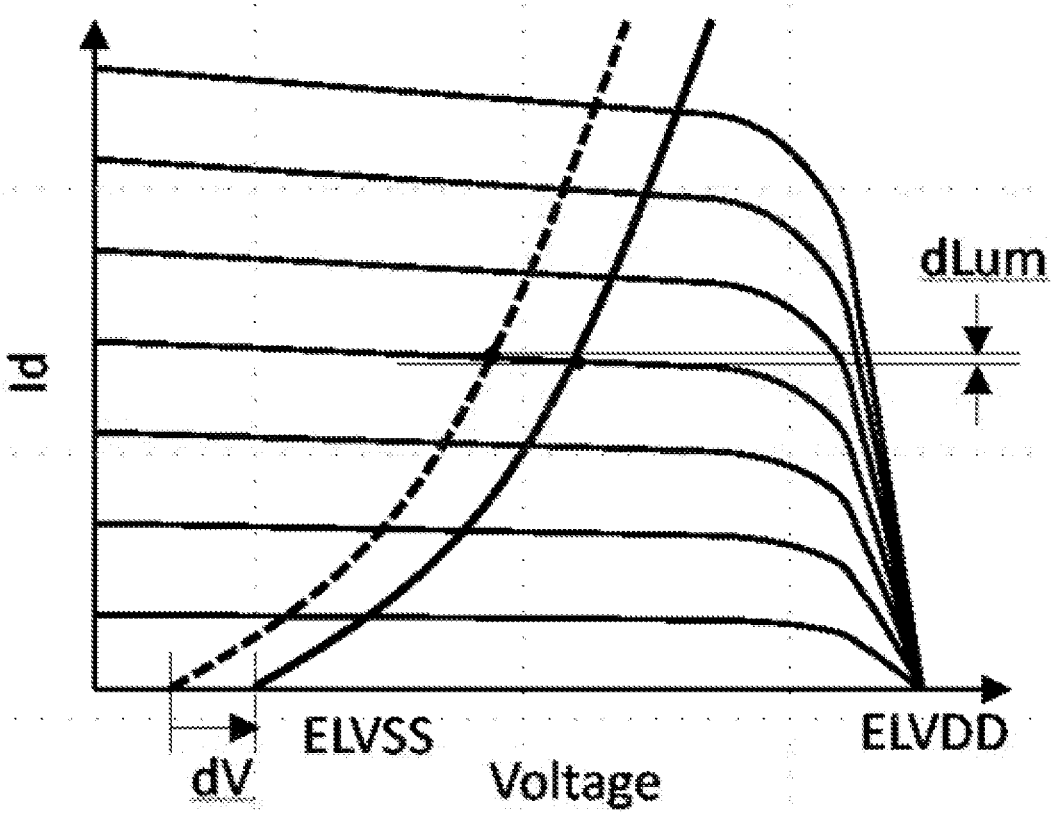
FIG. 7 is a voltage and current graph of the thin film transistor operating in the saturation region in the driving method of the display device according to the present disclosure.

FIG. 7 is a voltage and current graph of the thin film transistor operating in the saturation region in the driving method of the display device according to the present disclosure. As shown in FIG. 7, the horizontal axis represents voltage, and the vertical axis represents current. The brightness is adjusted by changing the ELVSS voltage, which is the first voltage of the OLED (the cathode driving voltage ELVSS). When changing the ELVSS voltage, the TFT works in the saturation region. According to the characteristic curve of the driving TFT, the change of the conduction current when the TFT is working in the saturation region can be used, wherein for different ELVSS, the respective conduction current corresponds to a slight linear change. The OLED is a current drive element, and the conduction current is the OLED current. Due to the change in the conduction current, the brightness of the OLED changes. As shown in FIG. 7, when the ELVSS voltage changes by ΔV, the current Id changes by ΔId, resulting in a change in the brightness of OLED by ΔLum. Ideally, the TFT exhibits constant current characteristics in the saturation region. But in fact, the conduction current changes with the change of Vds, and this non-ideal characteristic is used by us to change its conduction current.

Figure 8:
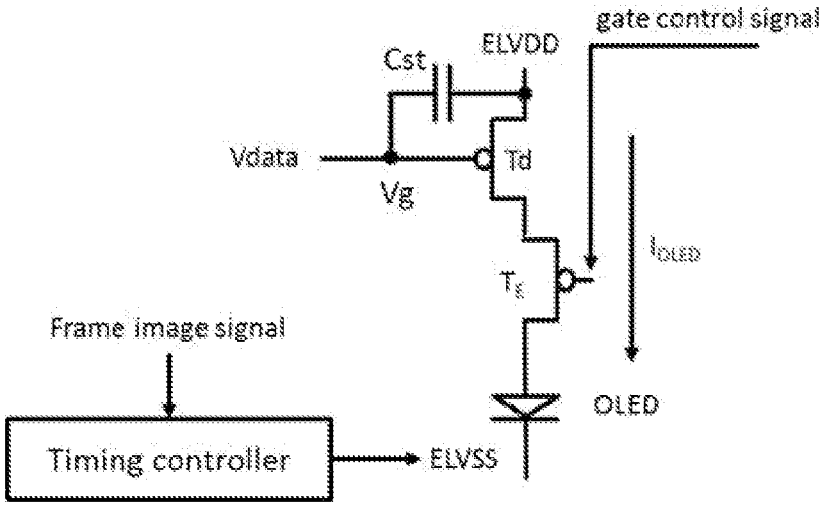
FIG. 8 is a circuit diagram of the display device according to the present disclosure.

FIG. 8 is a circuit diagram for the display device according to the present disclosure. As shown in FIG. 8, the present disclosure also provides a display device for implementing the above-mentioned driving method. The display device includes: an organic light emitting device OLED, whose cathode is connected to a cathode driving voltage ELVSS; a first transistor TE, the drain of the first transistor TE being connected to the anode of an organic light emitting device OLED; a second transistor Td, the source of the second transistor Td being connected to the driving voltage ELVDD, the drain of the second transistor being connected to the source of the first transistor TE, and a capacitor Cst being connected between the gate and the source of the second transistor Td. A frame image signal is generated by the timing controller, and the frame image signal is output to the gate of the second transistor Td. The frame image signal is stored in the capacitor. The frame image signal includes an active data region and a blank region based on a time sequence. After the first transistor TE is turned on, the frame image signal is input to the organic light emitting device. In the active data region of the frame image signal, the timing controller writes the data voltage into the gate of the thin film transistor, and applies it to the display device through the thin film transistor.

According to the display device of the present disclosure, the data voltage is written to the Vg point (Td gate) and stored in the capacitor Cst, then TE turning on the OLED to start emitting light. Referring to FIGS. 7 and 8, the Id-Vd characteristic curve in FIG. 7 is the working curve of Td when the OLED emits light. When the time of the active data region is over, it will enter the blank region. At this time, the OLED keeps emitting light. Then, changing the voltage of ELVSS will change the dotted position that intersects with the curve to be a solid position, thereby changing the size of Id, which is the size of $I_{OLED}$ in the driving circuit. Thus, the brightness of OLED is changed. When the timing controller determines that the blank region of the frame image signal is reached, the first voltage of the display device is changed to compensate the current of the gate driver and keep the brightness of the display device unchanged, but not limited to this.

In an embodiment, the time duration for changing the first voltage of the organic light emitting device decreases as the frequency of the frame image signal increases, but it is not limited to this.

In an embodiment, as the first voltage of the organic light emitting device increases, the operating current of the organic light emitting device decreases, but it is not limited to this.

In an embodiment, after leaving the blank region of the frame image signal as determined by the timing controller, the first voltage at the cathode of the organic light emitting device is restored, but it is not limited to this.

In an embodiment, the first voltage is a cathode driving voltage, and the second voltage is an anode driving voltage.

Figure 9:
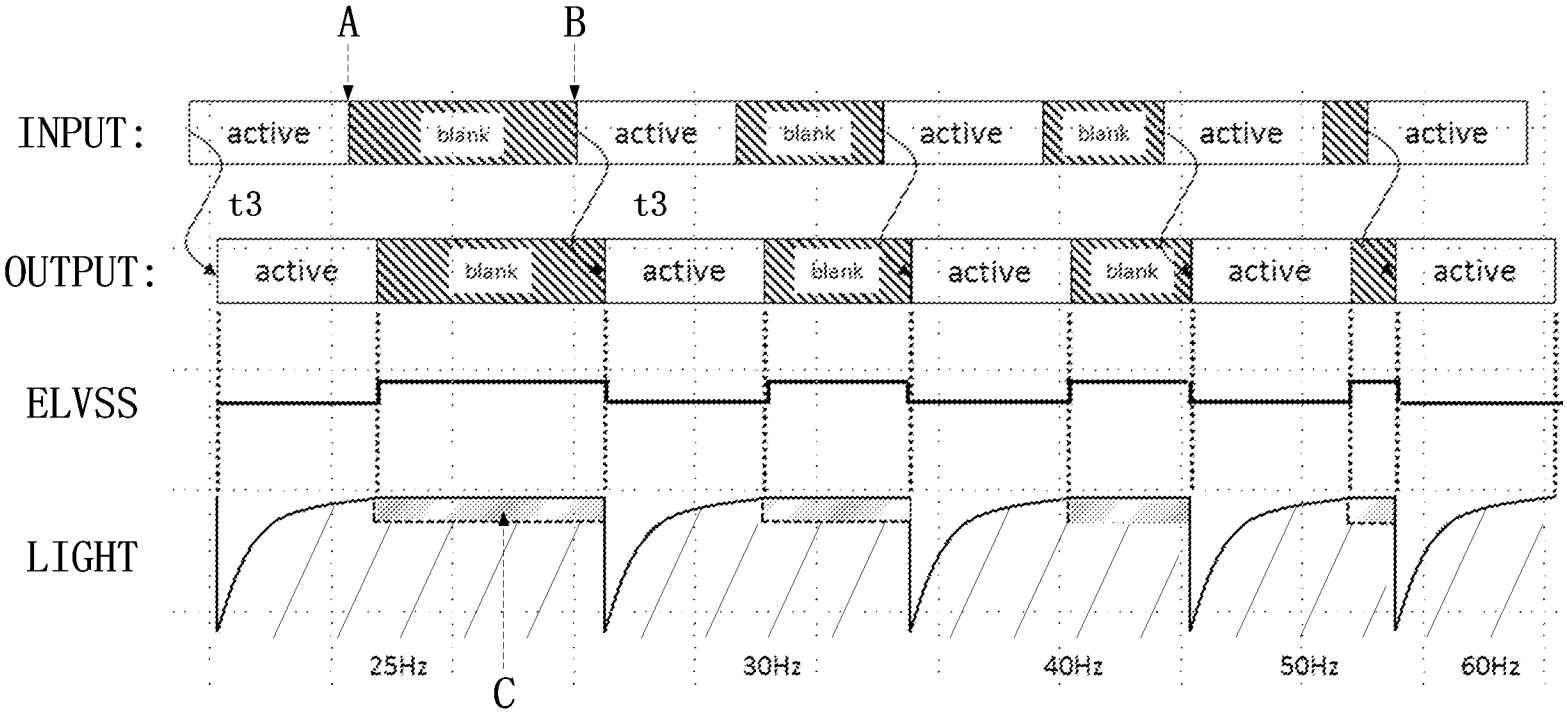
FIG. 9 is a schematic diagram for the implementation process of the driving method of the display device according to the present disclosure.

FIG. 9 is a schematic diagram of the implementation process for the driving method of the display device according to the present disclosure. As shown in FIG. 9, A is the time when the ELVSS voltage is changed once the blank is detected, B is the time when the voltage is changed back to ELVSS once the end of blank is detected, and C is the region where the brightness remains unchanged after the ELVSS voltage is changed. Since at different frequencies, the length of the active part is the same, and the length of the blank part is different, the ELVSS voltage is changed in the blank part of Vtotal. Thus, the brightness at each frequency such as 25 HZ, 30 HZ, 40 HZ, 50 HZ, 60 HZ, etc. remains consistent.

Figure 10:
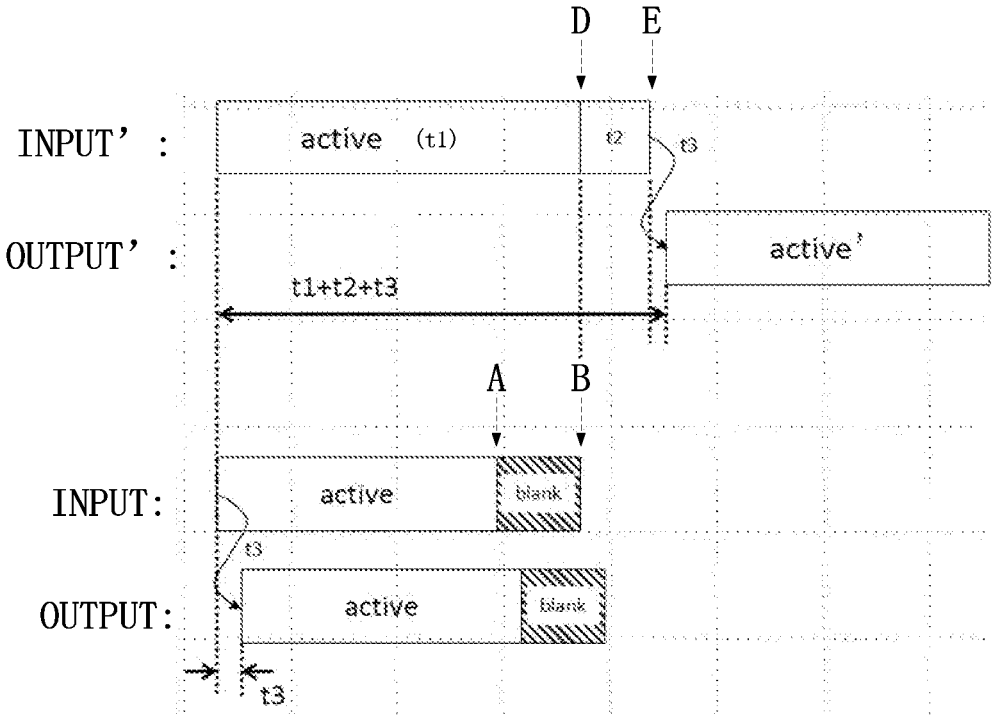
FIG. 10 is a schematic diagram of timing comparison between the driving method of the display device according to the present disclosure and the prior art.

FIG. 10 is a schematic diagram of timing comparison between the driving method of the display device according to the present disclosure and the prior art. As shown in FIG. 10, INPUT' is the input of the method for detecting refresh the rate according to the prior art, OUTPUT' is the output of the method for detecting the refresh rate according to the prior art, INPUT is the input according to the present disclosure, OUTPUT is the output according to the present disclosure, Active is a data signal, Active' is a processed data signal, A is the time when the ELVSS voltage is changed once the blank is detected, B is the time when the voltage is changed back to ELVSS once the end of blank is detected, t1 is the time duration of the active data signal, t2 is the time length required to call the data, and t3 is the output time delay of the system. Only when the graphics processing unit (GPU) finishes rendering the data of the next frame, the blank of the previous frame ends, and the picture of the next frame is displayed. Therefore, only after the end of the current frame can the frame rate of the current frame be known. If the refresh rate of the data signal is detected, it will inevitably cause a delay in the output signal. It can be seen that the total time delay of the method for detecting the refresh rate according to the prior art is (t1+t2+t3), and the total time delay according to the present disclosure is only t3. Therefore, there is no need to detect the refresh rate of the data signal according to the present disclosure, which can greatly reduce the output delay and improve the response time.

Figure 11:
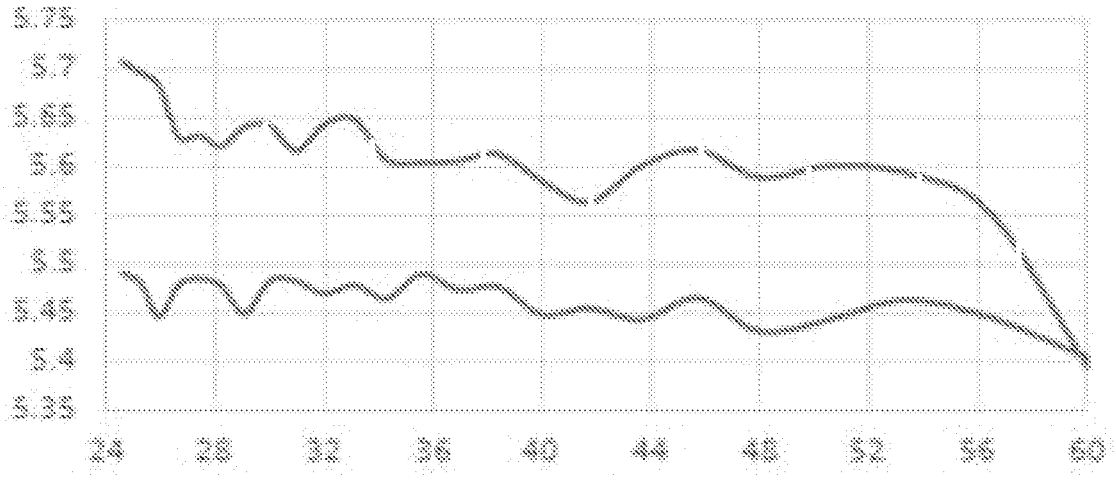
FIG. 11 is a schematic diagram of effect comparison between the driving method of the display device according to the present disclosure and the prior art.

FIG. 11 is a schematic diagram of effect comparison between the driving method of the display device according the present disclosure and the prior art. As shown in FIG. 11, the horizontal axis represents frequency (Hz), the vertical axis represents brightness (nits), the dotted line is a curve of brightness change at different frequencies according to the prior art, and the solid line is the curve of brightness change at different frequencies by using the present disclosure. It can be seen that the frequency in VRR changes in real time, and the brightness difference at each frequency needs to be kept as small as possible. The average brightness is kept constant by changing the ELVSS voltage. According to the measured brightness curves under 32 gray scales at different frequencies, it can be seen that by using the present disclosure, the brightness changes at different frequencies will be significantly improved.

In summary, the driving method of the display device and the display device according to the present disclosure can improve the brightness change under low gray scales. When the display frame rate is changed, the brightness change between consecutive frames will be significantly improved, and no detection is required for the refresh rate of the data signal, which can greatly reduce the output delay.

The above content is a further detailed description of the present disclosure in combination with specific embodiments, and it cannot be considered that the specific implementation of the present disclosure is limited to these descriptions. For those of ordinary skill in the technical field to which the present disclosure belongs, a number of simple deductions or substitutions can be made without departing from the concept of the present disclosure, which should be regarded as falling within the protection scope of the present disclosure.

The invention claimed is:

1. A driving method of a display device, comprising:

generating and outputting a frame image signal to an organic light emitting device, wherein the frame image signal comprises an active data region and a blank region based on a time sequence;

in the active data region of the frame image signal, using a timing controller to write a data voltage into a gate of a thin film transistor, store the data voltage in a storage capacitor, and apply the data voltage to the organic light emitting device through the thin film transistor; and in response to reaching the blank region of the frame image signal as determined by the timing controller, changing a first voltage at a cathode of the organic light emitting device to compensate an operating current of the organic light emitting device, thereby maintaining a brightness of a current frame image signal of the organic light emitting device to be the same as a brightness of a previous frame image signal, wherein time duration for changing the first voltage of the organic light emitting device decreases as frequency of the frame image signal increases.

2. The driving method of the display device according to claim 1, wherein the operating current of the organic light emitting device decreases as the first voltage of the organic light emitting device increases.

3. The driving method of the display device according to claim 1, wherein after leaving the blank region of the frame image signal as determined by the timing controller, the first voltage at the cathode of the organic light emitting device is restored.

4. The driving method of the display device according to claim 1, wherein the first voltage is a cathode driving voltage.

5. A display device, comprising:

an organic light emitting device, wherein a cathode of the organic light emitting device is connected to a first voltage;

a first transistor, wherein a drain of the first transistor is connected to an anode of the organic light emitting device; and a second transistor, wherein a source of the second transistor is connected to a second voltage, a drain of the second transistor is connected to a source of the first transistor, and a capacitor is connected between the gate and the source of the second transistor, wherein a frame image signal is generated and outputted by a timing controller to the gate of the second transistor, the frame image signal is stored in the capacitor, the frame image signal comprises an active data region and a blank region based on a time sequence, and after the first transistor is turned on, the frame image signal is input to the organic light emitting device; and in response to reaching the blank region of the frame image signal as determined by the timing controller, a first voltage at the cathode of the organic light emitting device is changed to compensate an operating current of the display device, thereby maintaining a brightness of a current frame image signal of the display device to be the same as a brightness of a previous frame image signal, wherein time duration for changing the first voltage of the organic light emitting device decreases as frequency of the frame image signal increases.

6. The display device according to claim 5, wherein the operating current of the organic light emitting device decreases as the first voltage of the organic light emitting device increases.

7. The display device according to claim 5, wherein after leaving the blank region of the frame image signal as determined by the timing controller, the first voltage at the cathode of the organic light emitting device is restored.

8. The display device according to claim 5, wherein the first voltage is a cathode driving voltage and the second voltage is an anode driving voltage.

* * * * *